US006598447B2

(12) United States Patent
Meliga

(10) Patent No.: US 6,598,447 B2
(45) Date of Patent: Jul. 29, 2003

(54) SECTION BENDING MACHINE

(75) Inventor: Mauro Meliga, Rivarossa (IT)

(73) Assignee: Tauring S.p.A., Leini (IT)

( * ) Notice: Subject to any disclaimer, the term of this patent is extended or adjusted under 35 U.S.C. 154(b) by 0 days.

(21) Appl. No.: 10/098,699

(22) Filed: Mar. 14, 2002

(65) Prior Publication Data

US 2002/0174700 A1 Nov. 28, 2002

Related U.S. Application Data

(63) Continuation of application No. PCT/IT01/00362, filed on Jul. 10, 2001.

(30) Foreign Application Priority Data

Jul. 14, 2000 (IT) ..... T02000A0707

(51) Int. Cl.[7] ..... B21D 7/08
(52) U.S. Cl. ..... 72/174; 72/175
(58) Field of Search ..... 72/173–175, 166, 72/170, 369

(56) References Cited

U.S. PATENT DOCUMENTS

| | | | | | |
|---|---|---|---|---|---|
| 808,619 | A | * | 1/1906 | Arthur | 72/171 |
| 913,004 | A | * | 2/1909 | Gordon | 72/173 |
| 2,335,028 | A | * | 11/1943 | Rose | 72/173 |
| 3,828,602 | A | * | 8/1974 | Leithiser | 72/173 |
| 4,061,005 | A | * | 12/1977 | Kawanami et al. | 72/369 |
| 4,367,641 | A | | 1/1983 | Mizutani | |
| 4,391,116 | A | | 7/1983 | Yogo | |
| 5,111,675 | A | | 5/1992 | Murata | |
| 5,992,210 | A | * | 11/1999 | Blurton-Jones | 72/369 |

FOREIGN PATENT DOCUMENTS

| | | | |
|---|---|---|---|
| DE | 197 17 232 A1 | | 10/1998 |
| JP | 9-103825 | * | 4/1997 |
| WO | 198 30 962 A1 | | 1/2000 |
| WO | WO 00/66289 A | | 11/2000 |

OTHER PUBLICATIONS

*Patent Abstracts of Japan*, vol. 1997, No. 08, Aug. 29, 1997 (1197–08–29) & JP 09 103825 (A (NISSHIN SEIKI KK), (Apr. 22, 1997) abstract.

*Patent Abstract of Japan*, vo 016, No. 388 (M–1297), (Aug. 18, 1992) & JP 04 127918 A (Opton Co Ltd), (Apr. 28, 1992) abstract; figures 1.2.

* cited by examiner

*Primary Examiner*—Daniel C. Crane
(74) *Attorney, Agent, or Firm*—Kenneth L. Sherman, Esq.; Myers Dawes Andras & Sherman; Vic Y. Lin, Esq.

(57) ABSTRACT

A machine for bending sections (2) having a longitudinal axis (3) and a constant cross section along the longitudinal axis (3) feeds the sections (2) longitudinally in a first direction (D1), and has a first and a second annular die (11, 12); an ass (15) connected to the second annular die (12) and movable in a plane perpendicular to the first direction (D1) to move the second annular die (12) into a number of operating positions with respect to the first annular die (11) to bend the sections (2); and a joint (22; 39) connecting the first and the second annular die (11, 12), and which forces the second annular die (12) to assume a given position with respect to the first annular die (11) for each position assumed by the assembly (15).

12 Claims, 4 Drawing Sheets

SECTION BENDING MACHINE

This application is a continuation of International Application PCT/IT01/00362 filed on Jul. 10, 2001.

TECHNICAL FIELD

The present invention relates to a section bending machine.

The machine according to the present invention is a penetration-type bending machine for bending sections, in particular tubes, bars and similar, in a number of directions to shape the sections in space.

For the sake of simplicity, the following description refers specifically to cylindrical-section tubes, it being understood, however, that the penetration bending machine may be used for bending any type of section having a given axis and a constant cross section along the axis.

BACKGROUND ART

On penetration-type tube bending machines, the tube is fed through a fixed first annular die and a second annular die movable with respect to the first, and, as the tube is fed through, the second annular die is moved to bend the tube. The extent to which the second annular die is moved determines the curvature of the tube.

One known penetration-type tube bending machine described in U.S. Pat. No. 5,111,675 feeds the tubes longitudinally in a given first direction, and comprises a fixed first annular die; and a second annular die, which is moved by a movable assembly in the first direction and along a plane perpendicular to the first direction to bend the tube in a number of directions in a region between the first and second annular die, and is connected to the movable assembly by a spherical joint enabling the second annular die to rotate freely as a function of the curvature assumed by the tube.

The above machine has several drawbacks owing to the tube, as it is being bent, exerting friction on respective portions of the first and second annular die. The degree of friction depends on the amount of curvature, the type of material from which the tube is made, the type of material from which the first and second annular die are made, and the speed at which the tube is fed through the first and second annular die, so that, when fed in a given direction through the second annular die, the tube generates severe friction on a given portion of the second annular die, and rotates the second annular die, which, rotating freely with respect to the movable assembly, tends to move crosswise with respect to the cross section of the tube, thus crushing the tube. In short, as it is being bent, the tube is ovalized by the second annular die being rotated by the tube itself.

Moreover, once the machine has finished bending one tube, the movable assembly aligns the second annular die with the first in the first direction, but does not position the second annular die to permit insertion of the next tube, so that the second annular die must be positioned manually, which takes time and does not guarantee the degree of precision expected of this type of machine.

Ovalizing of the tube is further aggravated when the tube is not perfectly smooth. That is, chips or machining debris on the lateral surface of the tube may result in seizure, thus greatly increasing rotation of the second annular die and the extent to which the tube is ovalized.

DISCLOSURE OF INVENTION

It is an object of the present invention to provide a section bending machine designed to eliminate the drawbacks typically associated with the known state of the art.

According to the present invention, there is provided a machine for bending sections, in particular tubes, bars and similar, having a longitudinal axis and a constant cross section along the longitudinal axis; the machine feeding the sections longitudinally in a first direction, and comprising a first and a second annular die, and an assembly connected to the second annular die and movable in a plane perpendicular to the first direction to move the second annular die into a number of operating positions with respect to the first annular die to bend the sections; and the machine being characterized by comprising a joint connecting the first and the second annular die, and which forces the second annular die to assume a given position with respect to the first annular die for each position assumed by said assembly.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 4:
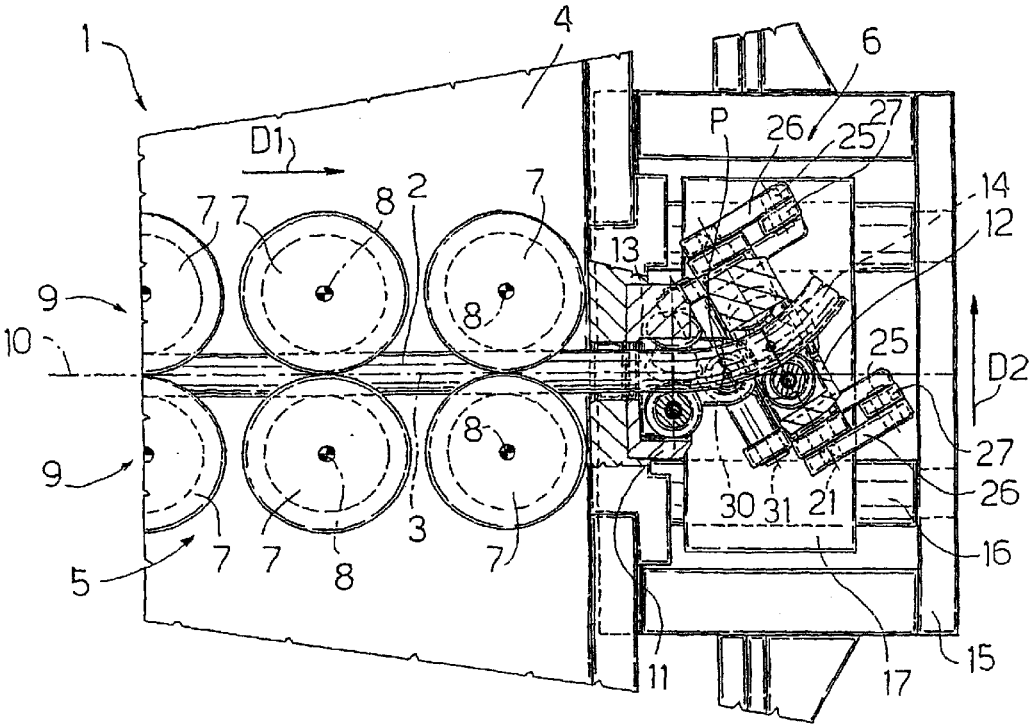
FIG. 4 shows a smaller-scale plan view, with parts in section and parts removed for clarity, of a section bending machine with the FIG. 1 unit in a first operating position.
Figure 5:
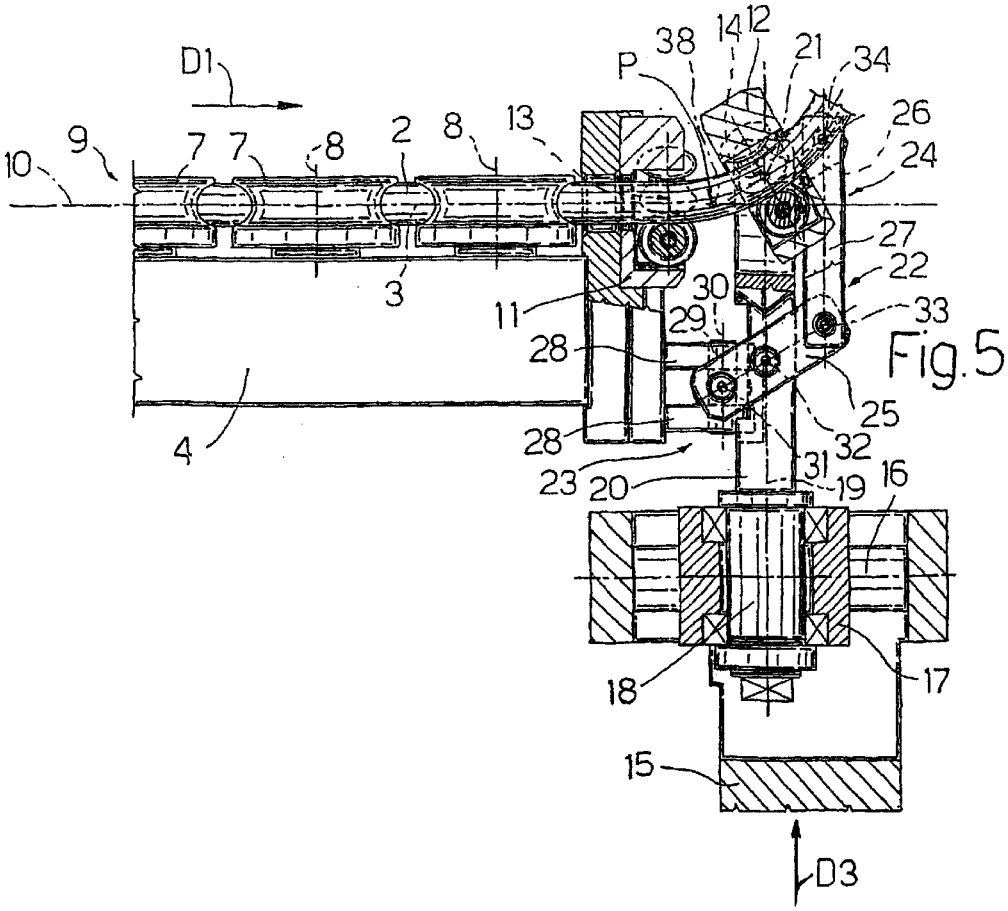
FIG. 5 shows a smaller-scale, partly sectioned side view, with parts removed for clarity, of the FIG. 4 machine with the FIG. 1 unit in a second operating position.

With reference to FIGS. 4 and 5, number 1 indicates as a whole a penetration-type bending machine for bending tubes 2 having a straight axis 3 and a constant cross section along axis 3.

Machine 1 comprises a frame 4; a guide device 5 for guiding tubes 2; and a bending unit 6 for bending tubes 2. Device 5 comprises a number of rollers 7, which rotate about vertical axes 8, are arranged in two facing rows 9, and have concave faces complementary to the shape of a tube 2 between the two rows 9, so that guide device 5 defines an axis 10 located between the two rows 9 and, in use, substantially coincident with axis 3 of tube 2. Some opposite rollers 7 are powered to push tube 2 in a direction D1 parallel to axis 10, and to feed tube 2 through bending unit 6. In one variation, none of rollers 7 is powered, and machine 1 comprises a device for pushing tubes 2 through guide device 5 and bending unit 6.

In another variation not shown, one row 9 of rollers 7 is mounted on a slide, which is movable in a direction D2 perpendicular to direction D1, is pushed against the opposite row 9 of roller 7 by a hydraulic cylinder as tube 2 is fed through, and is withdrawn from the opposite row 9 to permit insertion of tube 2. The pressure of the cylinder is adjustable to prevent ovalization, during bending, of tubes 2 with a high degree of friction.

Bending unit 6 comprises a fixed annular die 11 fixed to frame 4 at guide device 5 and having a passage 13 perpendicular to axis 10 and aligned with guide device 5; an annular die 12 movable with respect to annular die 11 and having a passage 14 identical with and adjustable with respect to passage 13; and an assembly 15 supporting annular die 12 and movable in a plane perpendicular to direction D1. That is, assembly 15 is connected to frame 4 in known manner by slides (not shown), and is moved by known actuators (not shown) in a horizontal direction D2 perpendicular to direction D1, and in a direction D3 perpendicular to directions D1 and D2. Assembly 15 supports two guides 16 parallel to direction D1; and a carriage 17 connected prismatically to guides 16 and supporting a shaft 18 rotating about a vertical axis 19. Shaft 18 is integral with a fork 20 supporting annular die 12 in rotary manner about a horizontal axis 21, so that annular die 12 rotates about axes 19 and 21 and translates in direction D1 with respect to assembly 15.

Figure 1:
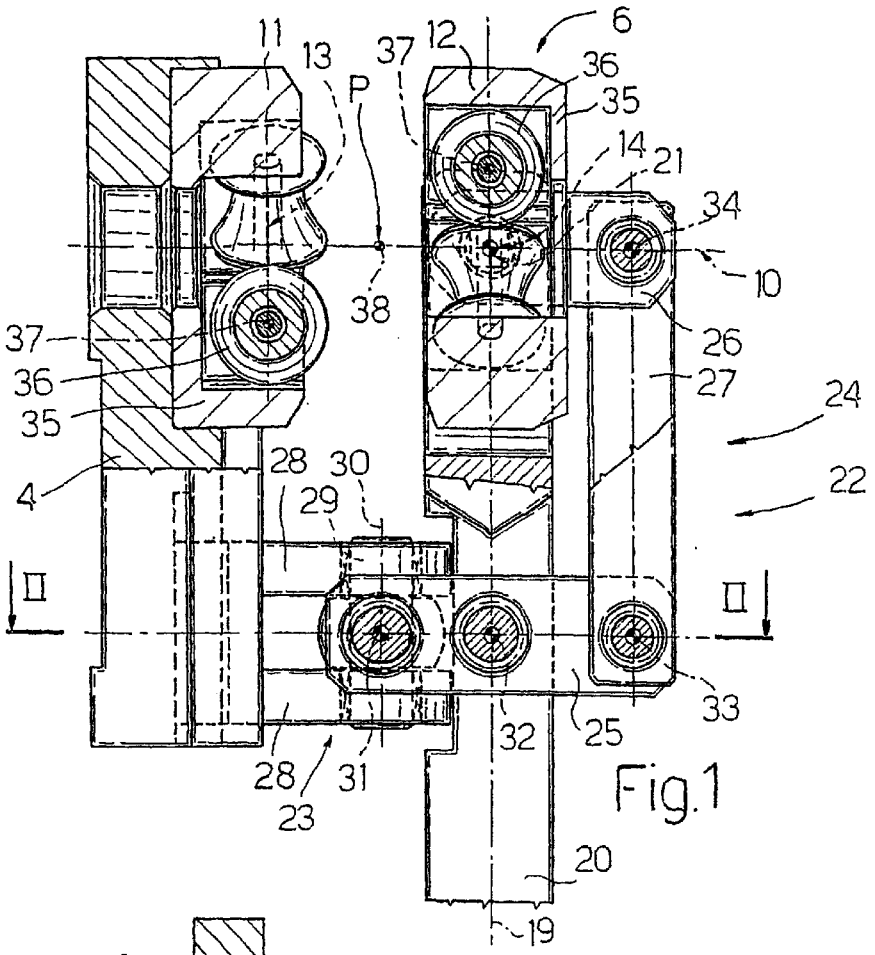
FIG. 1 shows a side view, with parts in section and parts removed for clarity, of a bending unit of a section bending machine in accordance with the present invention.
Figure 2:
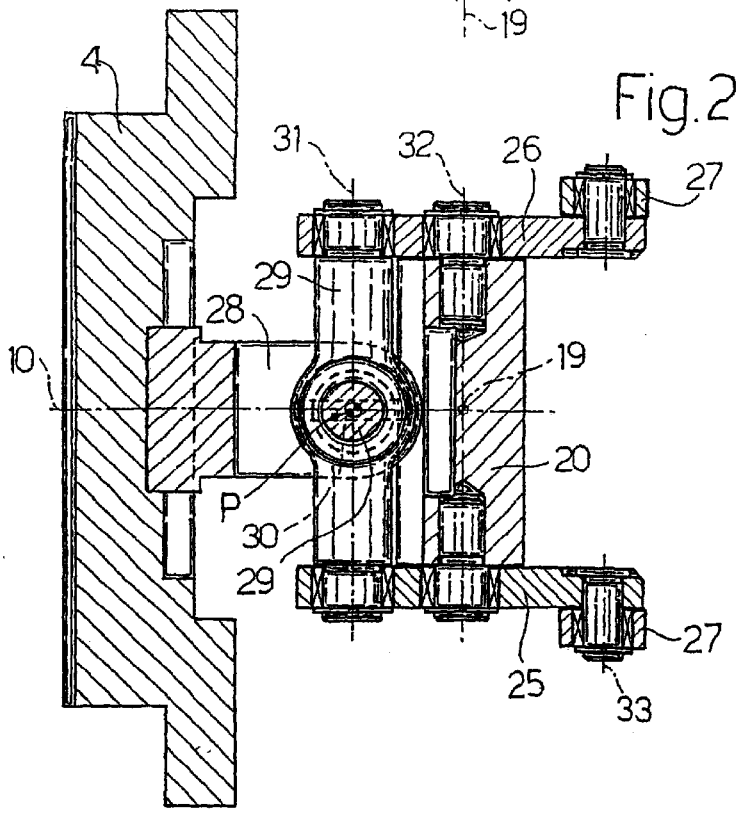
FIG. 2 shows a section, with parts removed for clarity, of the FIG. 1 unit along line II—II.
Figure 3:
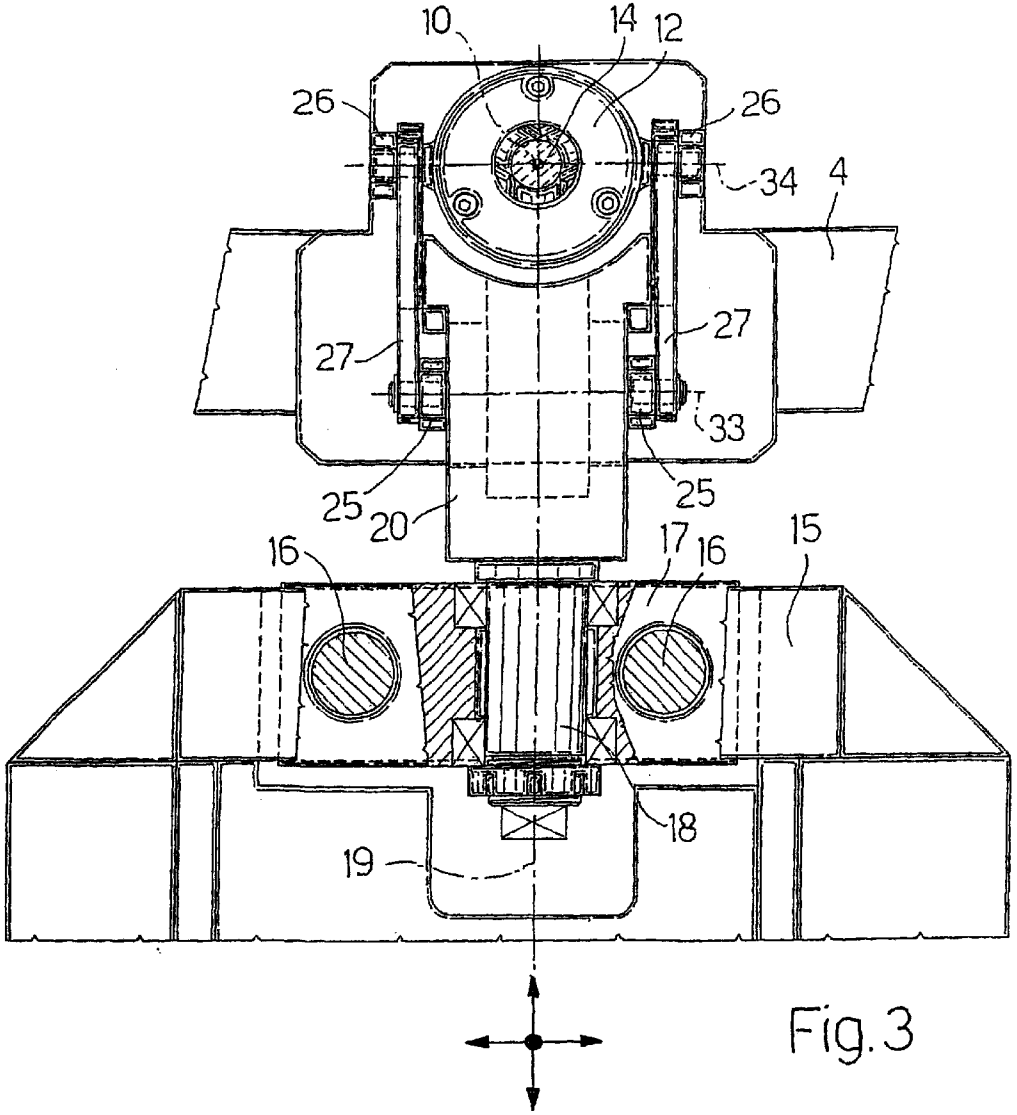
FIG. 3 shows a smaller-scale front view, with parts removed for clarity, of the FIG. 1 unit.

As shown more clearly in FIGS. 1 and 2, bending unit 6 comprises a joint 22 connecting annular dies 11 and 12. Joint 22 comprises a universal joint 23; and a mechanism 24 comprising levers 25 and 26 and rods 27, and connected to universal joint 23 and annular die 12. Universal joint 23 comprises a fork 28 integral with frame 4; and a cross 29 having a pin aligned with a vertical axis 30 and engaging fork 28, and two pins aligned along an axis 31 parallel to axis 21 and engaging levers 25, which in fact form a second fork of universal joint 23 and are connected to fork 20 in articulated manner about an axis 32 parallel to axis 31. Rods 27 are connected, at one end, to levers 25 to pivot about an axis 33 parallel to axis 31, and, at the opposite end, to levers 26 to pivot about an axis 34 also parallel to axis 31. Levers 26 are integral with die 12 to rotate die 12 about axis 21; and cross 29 is so located that axis 30 intersects axis 10 at a point P equidistant from passages 13 and 14.

Die 11 comprises a ring 35, and three rollers 36 rotating about respective axes 37 lying in a vertical plane; and rollers 36 are shaped to define the shape of passage 13, which lies in the same vertical plane as axes 37. Similarly, die 12 comprises a ring 35, and three rollers 36 rotating about respective axes 37 lying in a given plane; and rollers 36 are shaped to define the shape of passage 14, which lies in the same plane as axes 37 and is substantially identical with passage 13.

In FIG. 1, bending unit 6 of machine 1 is shown in the rest position, in which assembly 15 (not shown in FIG. 1) is set to a given position in which annular die 12 is aligned with annular die 11, and joint 22 maintains annular die 12 in such a position that section of passage 14 is parallel to section of passage.13.

The geometry of joint 22 is such that, when assembly 15 is positioned so that annular die 12 is aligned with annular die 11, passage 14 is parallel to passage 13; in which condition, tube 2 is fed in direction D1 through guide device 5 and annular dies 11 and 12. A known control device (not shown) controls operation of machine 1 and determines the movements of assembly 15 in directions D2 and D3 on the basis of a previously set bending program. FIG. 4 shows a position assumed by bending unit 6 following displacement of assembly 15 in direction D2; which displacement simultaneously rotates annular die 12 about axis 30 with respect to annular die 11, rotates fork 20 about axis 19 with respect to carriage 17, and moves carriage 17 with respect to guide 16 and assembly 15.

FIG. 5 shows a position assumed by bending unit 6 following displacement of assembly 15 in direction D3; which displacement moves carriage 17 along guides 16 and rotates annular die 12 about axis 21. The combination of said displacement and said rotation results in rotation of annular die 12 with respect to annular die 11 about a hypothetical axis 38 incident with axis 10 at point P and parallel to axis 21. The rotation of annular die 12 about axis 38 is due to the geometry of mechanism 24, which, by means of levers 25, 26 and rods 27, forms an articulated quadrilateral wherein axes 31, 33, 34 and 38 are the hinge axes of the articulated quadrilateral, which is deformed by vertical displacement of fork 20.

In general, displacement of assembly 15 in direction D2 rotates annular die 12 about axis 30 intersecting axis 10 at point P, and displacement of assembly 15 in direction D3 rotates annular die 12 with respect to annular die 11 about virtual axis 38 intersecting axis 10 at point P, so that the combined displacements of assembly 15 in directions D2 and D3 rotate annular die 12 with respect to annular die 11 about an axis through point P. This is due to joint 22 only imposing rotation of annular die 12 with respect to annular die 11 about point P. The geometry of joint 22 is so selected that point P is equidistant from sections passages 13 and 14. In other words, joint 22 ensures that each given position of assembly 15 corresponds to a given position of die 12 with respect to die 11 about point P.

Figure 7:
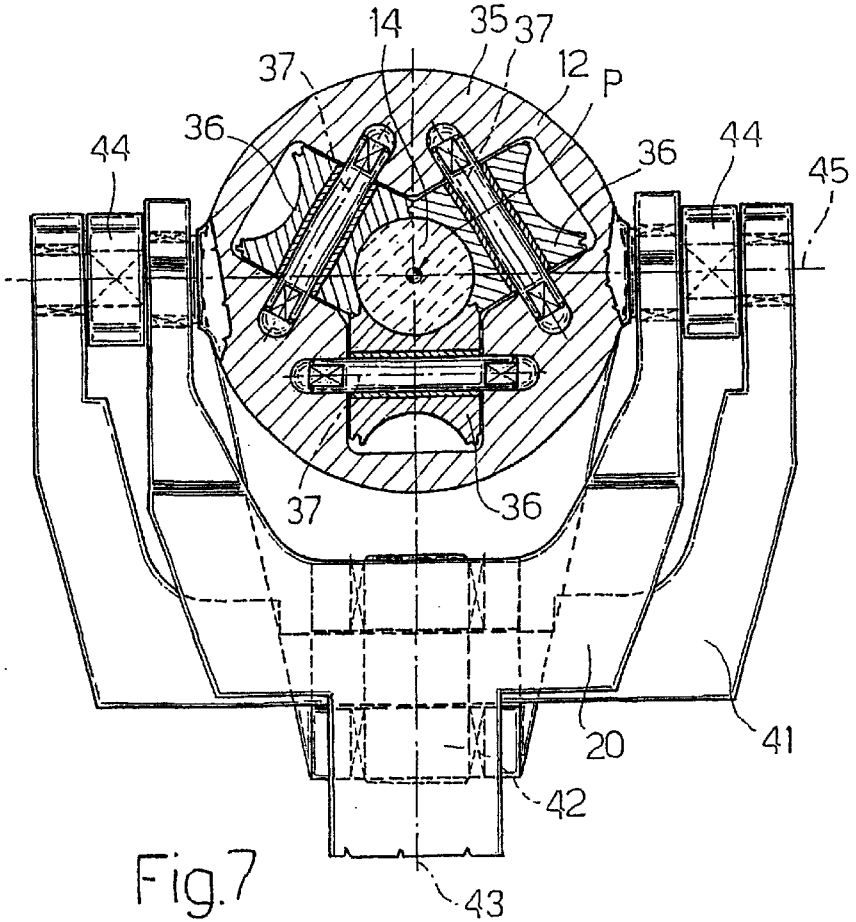
FIG. 7 shows a front view, with parts in section and parts removed for clarity, of the FIG. 6 variation.
Figure 6:
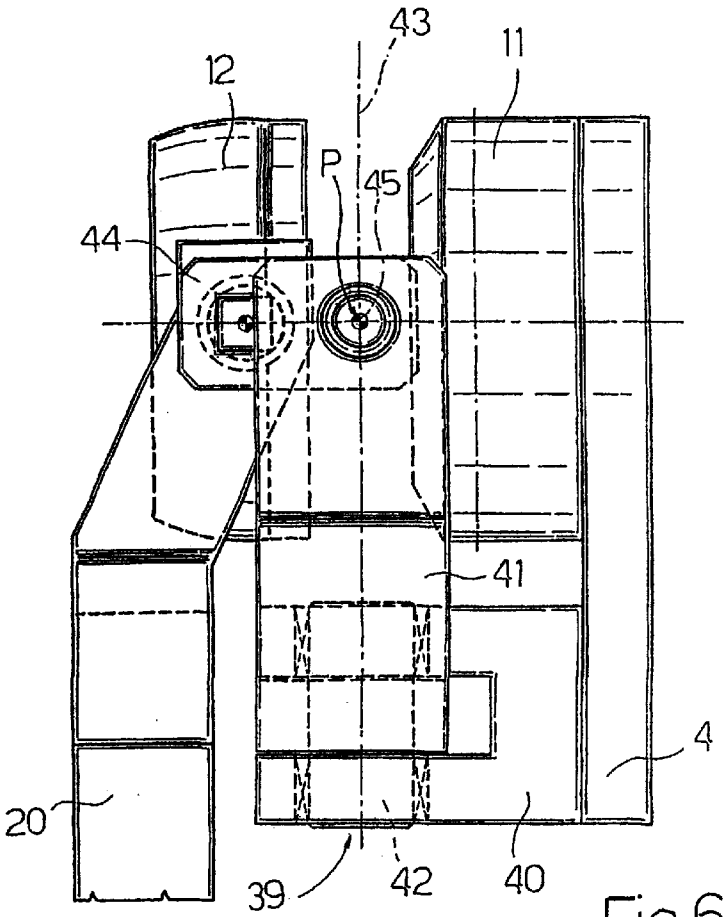
FIG. 6 shows a side view of a variation of the FIG. 1 unit.

In the FIGS. 6 and 7 variation, joint 22 is replaced with a joint 39 connecting annular dies 11 and 12 and comprising a fork 40 integral with frame 4; a fork 41 connected to annular die 12 and to a pin 42 having a vertical axis 43 about which fork 41 rotates with respect to fork 40; and two levers 44 integral with annular die 12 and rotating with respect to fork 41 about a horizontal axis 45.

Axes 43 and 45 intersect axis 10 at point P, which is equidistant from passages 13 and 14 of respective annular dies 11 and 12.

In actual use, joint 39 imposes the same constraint as joint 22, i.e. rotation of annular die 12 with respect to annular die 11 about point P, and imposes a given position of annular die 12 for each position assumed by assembly 15.

The extent to which annular die 12 is adjusted is directly proportional to the amount of displacement of assembly 15, which determines the position of annular die 12 by virtue of the constraints imposed by joint 22 or 39, which is designed to keep passage 14 perfectly perpendicular to axis 3 of the bent tube 2, and so prevent ovalization of tubes 2. Joint 22, 39 also provides for keeping passages 13 and 14 parallel in the rest position, and so eliminating the downtime required to position annular die 12 manually.

What is claimed is:

1. A machine for bending sections (2) having a longitudinal axis (3) and a constant cross section along the longitudinal axis (3); the machine feeding the sections (2) longitudinally in a first direction (D1), and comprising: a first and a second annular die (11, 12), and an assembly (15) connected to the second annular die (12) and movable in a plane perpendicular to the first direction (D1) to move the second annular die (12) into a number of operating positions with respect to the first annular die (11) to bend the sections (2); and the machine being characterized by comprising a joint (22; 39) connecting the first and the second annular die (11, 12), and which forces the second annular die (12) to assume a given position with respect to the first annular die (11) for each position assumed by said assembly (15); and the machine being characterized by comprising a guide device (5) for guiding said sections (2) along a first axis (10) parallel to said first direction (Dl); said joint (22; 39) imposing that said second annular die (12) only rotate with respect to the first annular die (11) about a point (P) located along said axis (10).

2. A machine as claimed in claim 1, characterized in that said point (P) is located between said first and second annular die (11, 12).

3. A machine as claimed in claim 2, characterized in that said first and said second annular die (11, 12) respectively define a first and a second passage (13, 14); said point (P) being equidistant from the first and second passage (13, 14).

4. A machine as claimed in claim 3, characterized in that said joint (22; 39) comprises a universal joint (23; 39) defining a second and a third axis (30, 31; 43, 45); at least the second axis (30; 43) intersecting said first axis (10) at said point (P).

5. A machine as claimed in claim 1, characterized by comprising a frame (4); said first annular die (11) being integral with said frame (4); and said assembly (15) being positionable selectively with respect to said frame (4) in a horizontal second direction (D2) perpendicular to the first direction (D1), and in a third direction (D3) perpendicular to the first and second direction (D1, D2).

6. A machine as claimed in claim 1, characterized in that said first and said second annular dies (11, 12) respectively define a first and a second passage (13, 14); said second annular die (12) only rotating with respect to the first annular die (11) about said point (P) located along said first axis (10) such that said second passage (14) remains perpendicular to an axis of a bent portion of said section traveling through said second passage (14).

7. A machine for bending sections (2) having a longitudinal axis (3) and a constant cross section along the longitudinal axis (3); the machine feeding the sections (2) longitudinally in a first direction (D1), and comprising: a first and a second annular die (11, 12), and an assembly (15) connected to the second annular die (12) and movable in a plane perpendicular to the first direction (D1) to move the second annular die (12) into a number of operating positions with respect to the first annular die (11) to bend the sections (2); and the machine being characterized by comprising a joint (22; 39) connecting the first and the second annular die (11, 12), and which forces the second annular die (12) to assume a given position with respect to the first annular die (11) for each position assumed by said assembly (15); and the machine being characterized by comprising a guide device (5) for guiding said sections (2) along a first axis (10) parallel to said first direction (D1); said joint (22; 39) imposing that said second annular die (12) only rotate with respect to the first annular die (11) about a point (P) located along said axis (10), said point (P) being located between said first and second annular die (11, 12); said first and said second annular die (11, 12) respectively defining a first and a second passage (13, 14); said point (P) being equidistant from the first and second passage (13, 14); said joint (22, 39) comprising a universal joint (23, 39) defining a second and a third acis (30, 31; 43, 45); at least the second axis (30; 43) intersecting said first axis (10) at said point (P); said joint (22) comprising a mechanism (24) having first levers (25), second levers (26) and rods (27) for positioning said second annular die (12).

8. A machine as claimed in claim 7, characterized in that said first levers (25) rotate about said third axis (31).

9. A machine as claimed in claim 8, characterized in that said second levers are integral with said second annular die (12) and parallel to said first levers (25); said rods being connected in articulated manner to said first and second levers (25, 26).

10. A machine as claimed in claim 9, characterized in that said first and second levers (25, 26) pivot respectively about a fourth and a fifth axis (32, 21) with respect to a fork (20) supporting said second annular die (12), which rotates about said fifth axis (21) with respect to said fork (20); said second levers (26) being integral with said second annular die (12); said fourth and said fifth axis (32, 21) being parallel to said third axis (31); and said first and second levers (25, 26) and said rods forming a virtual articulated quadrilateral having a virtual sixth axis (38) parallel to said third axis (31) and intersecting said first axis at said point (P).

11. A machine for bending sections (2) having a longitudinal axis (3) and a constant cross section along the longitudinal axis (3); the machine feeding the sections (2) longitudinally in a first direction (D1), and comprising: a first and a second annular die (11, 12), and an assembly (15) connected to the second annular die (12) and movable in a plane perpendicular to the first direction (D1) to move the second annular die (12) into a number of operating positions with respect to the first annular die (11) to bend the sections (2); and the machine being characterized by comprising a joint (22; 39) connecting the first and the second annular die (11, 12), and which forces the second annular die (12) to assume a given position with respect to the first annular die (11) for each position assumed by said assembly (15); the machine being characterized by comprising a frame (4); said first annular die (11) being integral with said frame (4); and said assembly (15) being positionable selectively with respect to said frame (4) in a horizontal second direction (D2) perpendicular to the first direction (D1), and in a third direction (D3) perpendicular to the first and second direction (D1, D2); said assembly (15) comprising guides (16) parallel to said first direction (D1); a carriage (17), supporting said second annular die (12), running along said guides (16).

12. A machine as claimed in claim 11, characterized in that said carriage (17) supports a fork (20) supporting said second annular die (12); said fork (20) rotating with respect to said carriage (17) about an eighth axis (19).

* * * * *